US006320305B1

(12) United States Patent
Ishikawa et al.

(10) Patent No.: US 6,320,305 B1
(45) Date of Patent: Nov. 20, 2001

(54) COLOR CATHODE RAY TUBE WITH SHADOW MASK

(75) Inventors: Masayoshi Ishikawa, Kumagaya; Naohisa Takano, Fukaya, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/215,255

(22) Filed: Dec. 18, 1998

(30) Foreign Application Priority Data

Dec. 18, 1997 (JP) ..... 9-349183
Nov. 25, 1998 (JP) ..... 10-333877

(51) Int. Cl.[7] ..... H01J 29/80
(52) U.S. Cl. ..... 313/402; 313/407; 313/408
(58) Field of Search ..... 313/402, 403, 313/404, 405, 406, 407, 408

(56) References Cited

U.S. PATENT DOCUMENTS 3,370,194 * 2/1968 Schwartz et al. ..... 313/402
3,671,794 * 6/1972 Nakamura et al. ..... 313/402
4,866,333 * 9/1989 Tokita et al. ..... 313/406
5,780,962 * 7/1998 Fujii et al. ..... 313/402
6,057,641 * 5/2000 Yoshida et al. ..... 313/404

FOREIGN PATENT DOCUMENTS 9-199044 7/1997 (JP) .
149339-A * 6/1989 (JP) ..... 313/402
417236-A * 1/1992 (JP) ..... 313/402

* cited by examiner

*Primary Examiner*—Nimeshkumar D. Patel
*Assistant Examiner*—Mariceli Santiago
(74) *Attorney, Agent, or Firm*—Pillsbury Winthrop LLP

(57) ABSTRACT

A color cathode ray tube is provided with a shadow mask including a substantially rectangular mask body having a large number of electron beam passage apertures, and a substantially rectangular mask frame provided at a peripheral portion of the mask body. The mask frame has a pair of long side walls extending in parallel to the major axis of the mask body and a pair of short side walls extending in parallel to the minor axis of the mask body. Mask holders are respectively provided on the outer surfaces of the long and short side walls, and are engaged with supporting pint provided on a skirt portion of the panel, thereby supporting the shadow mask. The mask frame is formed to satisfy the following relationship:

$$F1/(S1 \times t1) = F2/(S2 \times t2)$$

where S1 is the area of the outer surface of the long side wall of the mask frame, t1 is the thickness of the long side wall, S2 is the area of the outer surface of the short side wall, t2 is the thickness of the short side wall, F1 is the pushing pressure acting from the mask holder onto the long side wall when the mask holder is engaged with the supporting pin to support the shadow mask, and F2 is the pushing pressure acting from the mask holder onto the short side wall when the mask holder is engaged with the supporting pin to support the shadow mask.

12 Claims, 3 Drawing Sheets

COLOR CATHODE RAY TUBE WITH SHADOW MASK

BACKGROUND OF THE INVENTION

The present invention relates to a color cathode ray tube having a shadow mask.

In general, a color cathode ray tube has an envelope having a panel and a funnel. The panel includes a substantially rectangular effective portion and a skirt portion provided at a peripheral portion of the effective portion. The funnel is joined to the skirt portion. A phosphor screen is formed on the inner surface of the effective portion of the panel, and comprises three-color phosphor layers which emit three color light components, blue, green, and red. A substantially rectangular shadow mask is arranged inward of and opposite to the panel.

Furthermore, in the color cathode ray tube, an electron gun for emitting three electron beams is provided within a neck of the funnel. The three electron beams emitted from the electron gun are deflected by a deflecting unit mounted on the outer side of the funnel, and horizontally and vertically scanned over the phosphor screen through the shadow mask, thereby displaying a color image.

The shadow mask is provided to sort the three electron beams emitted from the electron gun so that they correctly land on the three-color phosphor layers. The shadow mask comprises a substantially rectangular mask body and a substantially rectangular mask frame having long and short side walls attached to a peripheral portion of the mask body. The mask body includes a surface opposing the phosphor screen and having a number of electron beam passage apertures.

The shadow mask is supported inside the panel. To be more specific, elastic supporting members are fixed to the long and short side walls of the mask frame, and are respectively engaged with supporting pins provided at the skirt portion of the panel, thereby supporting the shadow mask. The supporting members are formed such that pushing pressures of the supporting members, which are caused by the elastic deformation of the supporting members when they are engaged with the supporting pins, equally act on the long and short side walls of the mask frame.

In order for such a color cathode ray tube to display an image having a high color purity on the phosphor screen, the shadow mask needs to be located to have a predetermined positional relationship with the phosphor screen, and in particular, it needs to be positioned such that the distance between the mask body and the inner surface of the effective portion of the panel falls within an allowable range.

However, only about 20% of the electron beams emitted from the electron gun reach the phosphor screen through the electron beam passage apertures of the mask body, and about 80% of the emitted electron beams impinge on the shadow mask. Due to impingement of electron beams, the shadow mask is heated, and thus thermally expands. As a result, it is displaced from the predetermined position, and the electron beams do not correctly land on target phosphor layers, thus lowering the color purity.

More specifically, lowering of the color purity due to thermal expansion of the shadow mask occurs in the following manners:

First, the mask body is mainly heated at an initial stage of the operation of the color cathode ray tube, and expands toward the phosphor screen (doming). Alternatively, local doming occurs due to impingement of electron beams which have high energy when a high luminance image is locally displayed.

Second, the heat of the mask body gradually propagates to the mask frame, and both the mask body and the mask frame thermally expand, as a result of which the color purity lowers.

Lowering of the color purity due to doming of the mask body in the above first manner is caused by displacement of the landing positions of electron beams on the phosphor layers from the predetermined target positions toward the center of the screen. This lowering of color purity (hereinafter referred to as PD-1) can be restricted by forming the mask body by a material having a low thermal expansion coefficient, such as invar, so as to reduce the degree of doming.

In contrast, lowering of the color purity due to thermal expansion of the mask body and the mask frame (which is hereinafter referred to as PD-2) occurs through the following process: the mask body is pulled in a radial direction due to thermal expansion of the mask frame, and as a result, the landing positions of the electron beams are displaced from the predetermined positions on the phosphor layers in a radial direction of the screen. The PD-2 can be restricted, if the mask frame, as well as the mask body, is formed of a material having a low thermal expansion coefficient. However, in general, such a material having a low thermal expansion coefficient is expensive, as compared with a cold-rolled steel plate applied to an ordinary cathode ray tube. Therefore, the material increases the manufacturing cost of the color cathode ray tube, and it is not advisable to use the material. Conventionally, the mask frame is thus formed of a cold-rolled steel plate. Instead, various methods have been proposed, which use various supporting members having specific shapes and formed of specific materials, as the elastic supporting member supporting the shadow mask, in order to prevent the PD-2.

In the above conventional color cathode ray tube, as described above, the structure for supporting the shadow mask is designed such that pushing pressures from the supporting members act equally on the long and short side walls of the mask frame, when the elastic supporting members fixed to the mask frame are engaged with the supporting pins provided at the panel. Thus, the pushing pressure acting on unit volume (unit surface area×plate thickness) of the long side walls differs from the pushing pressure acting on unit volume of the short side walls.

In this case, if the elastic supporting members are attached to the mask frame so as to extend in the same rotating direction, the following problem arises: the mask frame is deformed to be lozenge-shaped, and electron beams are incident such that in the vicinity of four diagonal portions of the screen, the beam spots formed on the phosphor layers move non-uniformly in a radial direction of the screen, and as a result, the color quality of the image lowers.

It is difficult to correct lowering of the color purity, which is caused by the above-mentioned non-uniform movement of the beams spots, even if the shape and material of the supporting member are changed as in the proposed various methods.

BRIEF SUMMARY OF THE INVENTION

The present invention has been made to solve the above problems, and its object is to provide a color cathode ray tube wherein the mask frame of the shadow mask is prevented from being non-uniformly deformed when it thermally expands, and thus the lowering of the color purity due to the thermal expansion of the shadow mask can be corrected.

In order to achieve the above object, a color cathode ray tube according to the present invention comprises:

an envelope including a panel having a substantially rectangular effective portion and a skirt portion provided at a peripheral portion of the effective portion, and a funnel joined to the skirt portion, the effective portion having an inner surface on which a phosphor screen is formed;

a shadow mask provided opposite to the phosphor screen; and an electron gun arranged within a neck of the funnel, for emitting electron beams onto the phosphor screen through the shadow mask.

The shadow mask comprises:

a substantially rectangular effective surface having a large number of electron beam passage apertures, for allowing the electron beams to pass therethrough, the effective surface having a center located on a tube axis, and a major axis and a minor axis extending perpendicular to each other through the center;

a substantially rectangular mask frame provided at a peripheral portion of the mask body, and having a pair of long side walls extending in parallel to the major axis of the effective surface and a pair of short side walls extending in parallel to the minor axis of the effective surface; and elastic supporting members respectively provided on outer surfaces of the long side walls and short side walls of the mask frame, the elastic supporting members being respectively engaged with supporting pins provided on the skirt portion, thereby supporting the shadow mask.

The mask frame is formed to satisfy the following relationship:

$$F1/(S1\times t1)\approx F2/(S2\times t2)$$

where S1 is the area of the outer surface of the long side wall of the mask frame, t1 is the thickness of the long side wall, S2 is the area of the outer surface of the short side wall, t2 is the thickness of the short side wall, F1 is the pushing pressure acting from the elastic member onto the long side wall when the elastic member is engaged with the supporting pin to support the shadow mask, and F2 is the pushing pressure acting from the elastic member onto the short side wall when the elastic member is engaged with the supporting pin to support the shadow mask.

In the color cathode ray tube, it is preferable that the mask frame satisfy the following relationship:

$$0.9 < \frac{F1/(S1\times t1)}{F2/(S2\times t2)} < 1.1$$

Furthermore, in a color cathode ray tube according to the present invention, the mask frame is formed to satisfy the following relationship:

$$F1/S1\approx F2/S2$$

where S1 is the area of the outer surface of the long side wall of the mask frame, S2 is the area of the outer surface of the short side wall, F1 is the pushing pressure acting from the elastic member onto the long side wall when the elastic member is engaged with the supporting pin to support the shadow mask, and F2 is the pushing pressure acting from the elastic member onto the short side wall when the elastic member is engaged with the supporting pin to support the shadow mask.

In the color cathode ray tube, it is preferable that the mask frame satisfies the following relationship:

$$0.9 < \frac{F1/S1}{F2/S2} < 1.1$$

Moreover, in a color cathode ray tube according to the present invention, the mask frame is formed to satisfy the following relationship:

$$F1/Lx\approx F2/Ly$$

where Lx is the length of the long side wall of the mask frame which is measured along the major axis, Ly is the length of the short side wall of the mask frame which is measured along the minor axis, F1 is the pushing pressure acting from the elastic member onto the long side wall when the elastic member is engaged with the supporting pin to support the shadow mask, and F2 is the pushing pressure acting from the elastic member onto the short side wall when the elastic member is engaged with the supporting pin to support the shadow mask.

In the color cathode ray tube, it is preferable that the mask frame satisfy the following relationship:

$$0.9 < \frac{F1/Lx}{F2/Ly} < 1.1$$

In the color cathode ray tube, the pushing pressures F1 and F2 are adjusted to satisfy the above relationship, by changing at least one of the height and plate thickness of each of the long and short side walls, and the shape, plate thickness and material of each of the elastic supporting members, and each of those distances between the outer surfaces of the long and short side walls and the supporting pins which are measured while the shadow mask is supported.

When the shadow mask which satisfies the above-mentioned relationship is heated, it substantially uniformly thermal-expands throughout its entire outer periphery. Thus, when electron beams are landed on the phosphor screen, the electron beam spots formed on the phosphor layers are substantially uniformly displaced in a radial direction of the phosphor screen. Therefore, such landing displacement can be relatively easily corrected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode ray tube according to an embodiment of the present invention will now be explained in detail with reference to the accompanying drawings.

Figure 1:
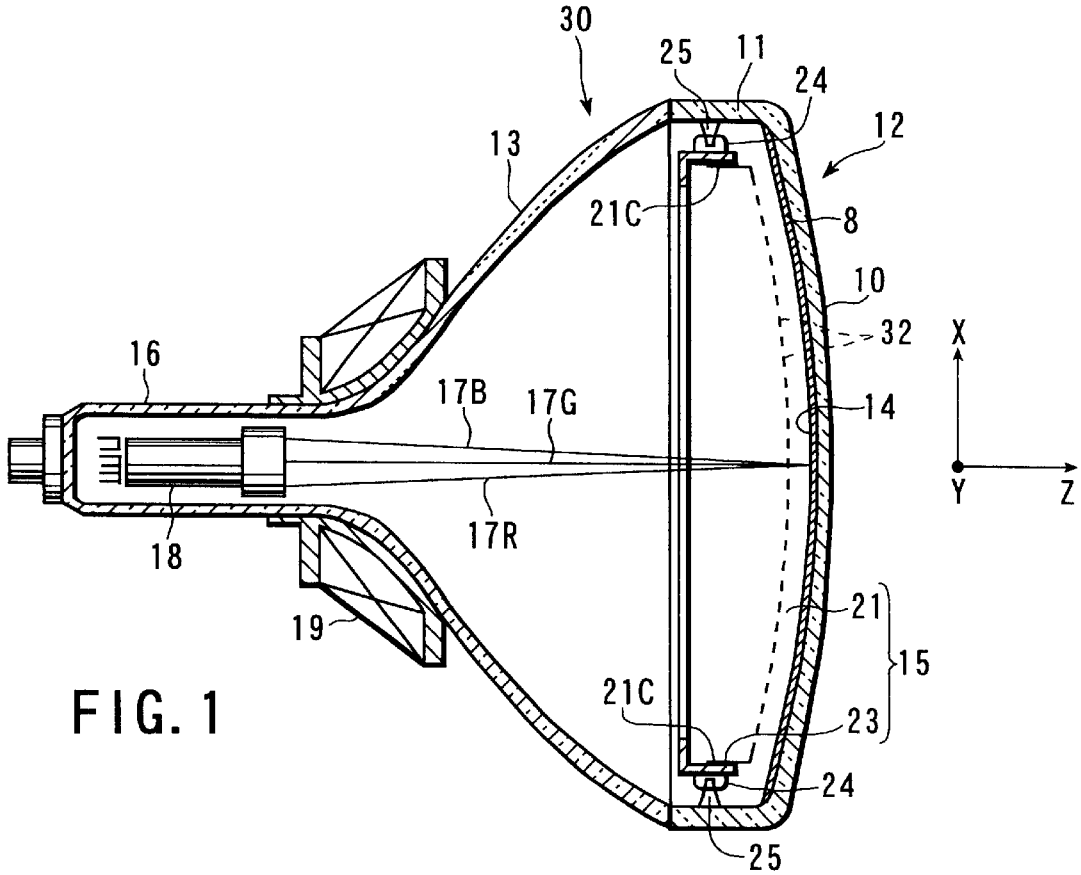
FIG. 1 is a cross-sectional view of a color cathode ray tube according to an embodiment of the present invention.

As shown in FIG. 1, the color cathode ray tube has a vacuum envelope 30 formed of glass. The envelope 30 comprises a panel 12 and a funnel 13. The panel 12 includes a substantially rectangular face plate 10 and a skirt portion 11 provided at a peripheral portion of the face plate 10. The funnel 13 is joined to the skirt portion 11. The face plate 10 has a substantially rectangular effective portion 8 having a horizontal axis X and a vertical axis Y which are perpendicular to each other and also perpendicular to a tube axis Z.

A phosphor screen 14 is formed on an inner surface of the effective portion 12, and comprises three-color phosphor layers which emit blue, green and red light components. A substantially rectangular shadow mask 15 is located inside the phosphor screen 14 with a predetermined distance therefrom. In a neck 16 of the funnel 13 is arranged an electron gun 18 for emitting three electron beams 17B, 17G and 17R.

In the color cathode ray tube, the three electron beams 17B, 17G and 17R emitted from the electron gun 18 are deflected by a magnetic field generated from a deflecting unit 19 mounted on an outer side of the funnel 13, and horizontally and vertically scans over the phosphor screen 14 through the shadow mask 15, thereby displaying a color image.

Figure 2:
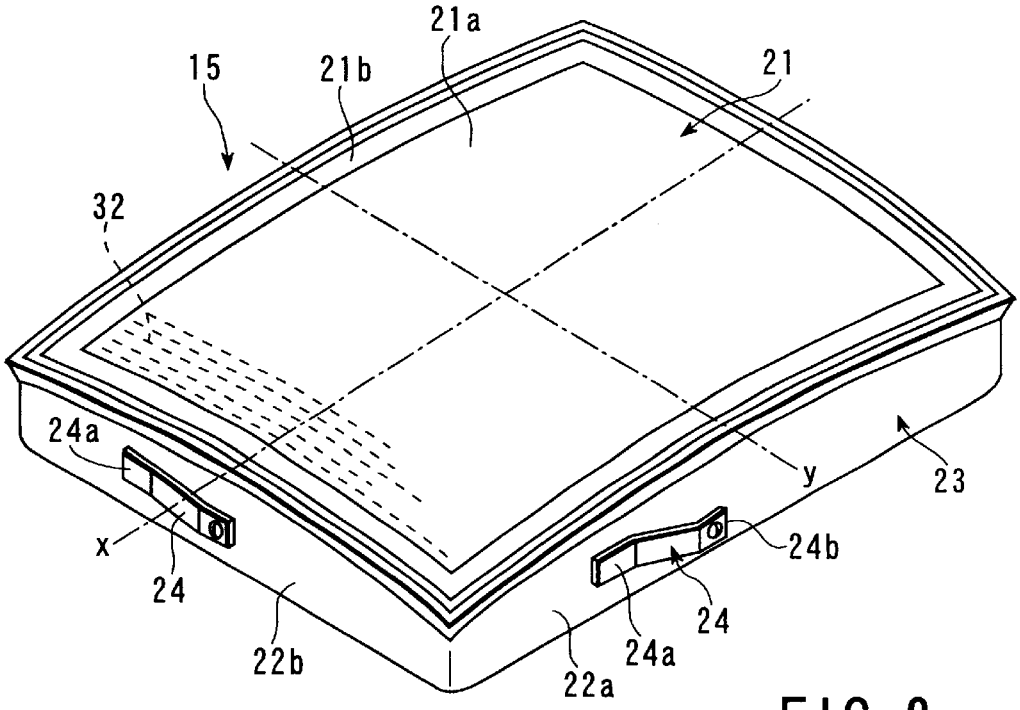
FIG. 2 is a perspective view of a shadow mask of the color cathode ray tube.

As shown in FIGS. 1 and 2, the shadow mask 15 comprises a substantially rectangular mask body 21 and a substantially rectangular mask frame 23 attached to a peripheral portion of the mask body 21. The mask body 21 has a substantially rectangular effective surface 21*a* and a skirt portion 21*c*, which are formed integral with each other, with a non-aperture portion 21*b* interposed between the effective surface 21*a* and the skirt portion 21*c*. The non-aperture portion 21 is formed in such a manner as to surround the effective surface 21*a*. The effective surface 21*a* has a large number of electron beams passage apertures 31 formed therein, and is located opposite to the phosphor screen 14. Furthermore, the effective surface 21*a* has a center O located on the tube axis Z, and a major axis x and a minor axis y which extend perpendicular to each other through the center O, and respectively correspond to the horizontal axis X and the vertical axis Y of the panel 12. In addition, the effective surface 21*a* has a pair of long sides parallel to the major axis x and a pair of short sides parallel to the minor axis y.

The shadow mask 15 is elastically supported inward of the panel 12. To be more specific, mask holders 24 serving as elastic supporting members are provided on long side walls 22*a* and short side walls 22*b* of the mask frame 23, respectively, and are engaged with respective supporting pins 25 provided at the skirt portion 11 of the panel 12, thereby supporting the shadow mask 15. Each of the mask holders 24 is formed of a belt-like metal plate which is bent in a predetermined shape. In addition, each mask holder 24 has a fixed portion 24*a* welded to the mask frame 23 and a fee end portion 24*b* having a through hole through which the supporting pin 25 is inserted.

Figure 3:
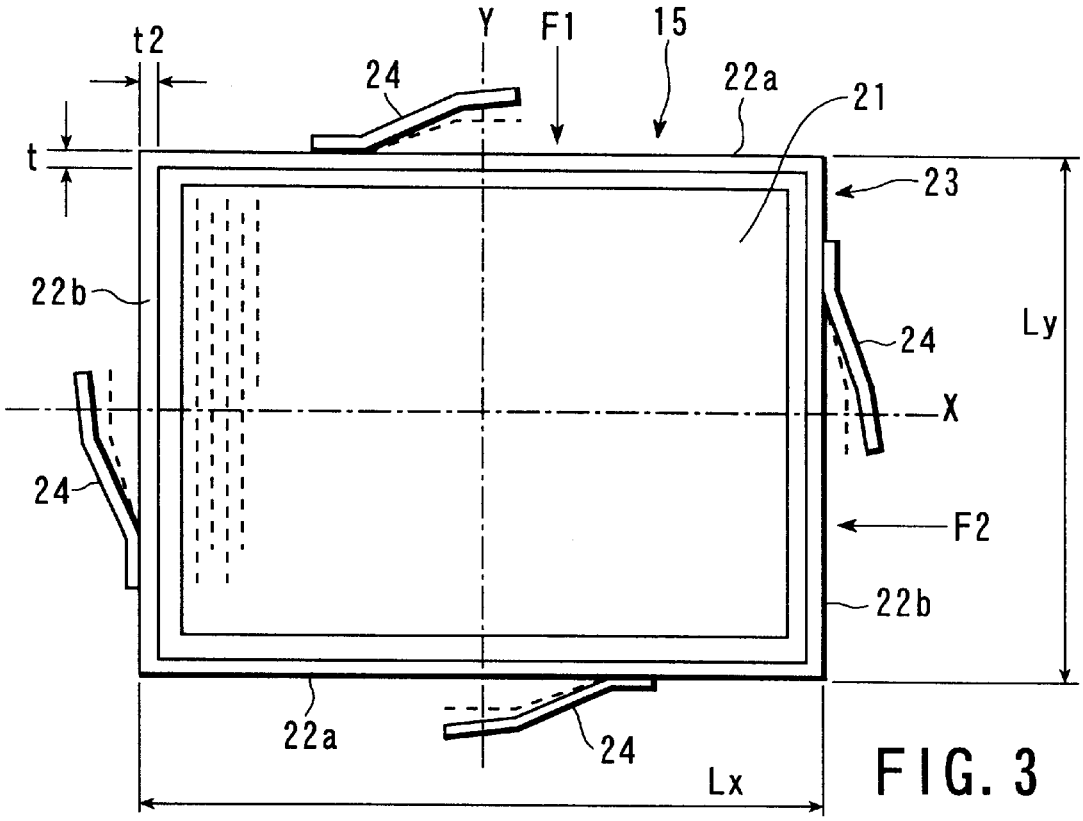
FIG. 3 is a front view for illustrating a positional relationship between the shadow mask and mask holders for supporting the shadow mask.

In particular, the mask frame 23 is formed to satisfy the following formula (1), and preferably to satisfy the following formula (2):

$$F1/(S1\times t1)\approx F2/(S2\times t2) \quad (1)$$

$$0.9 < \frac{F1/(S1\times t1)}{F2/(S2\times t2)} < 1.1 \quad (2)$$

where S1 is the area of the outer surface of the long side wall 22*a* of the mask frame 23 (which is measured, with the length of the mask frame along the major axis x defined as a long side length), t1 is the plate thickness of the long side wall, S2 is the area of the outer surface of the short side wall 22*b* (which is measured, with the length of the frame along the minor axis y, i.e., the width of the frame, defined as a short side length), t2 is the plate thickness of the short side wall, F1 is the pushing pressure acting on the long side wall 22*a* due to the elastic deformation of the mask holder 24 which occurs when the mask holder 24 is engaged with the supporting pin 25 with being compressed as illustrated by a broken line in FIG. 3, and F2 is the pushing pressure acting on the short side wall 22*b* due to the elastic deformation of the mask holder 24 which occurs when the holder 24 is engaged with the supporting pin 25 with being compressed as illustrated by a broken line in FIG. 3.

When the mask holders 24 are engaged with the respective supporting pins 25 on the panel 12 with being compressed, a variance between the pushing pressure F1 acting on the long side wall 22*a* and the pushing pressure F2 acting on the short side wall 22*b* is generated, the greatest variance being 0.1 kg ($|F1-F2|\leqq 0.1$ kg). Furthermore, in general, a variance between the lengths Lx of the long side walls 22*a* is approximately ±0.4 mm, and the variance between the lengths Ly of the short side walls 22*b* is approximately 0.4 mm. In addition, the above pushing pressures F1 and F2 are generally set to be 1 to 2 kg, and a variance among the pushing pressures F1 and F2 is about 3 to 5% of 1 to 2 kg. Further, in an ordinary color cathode ray tube, the lengths of the side walls of the mask frame are 250 to 400 mm, and a variance among the lengths is about 1% of 250 to 400 mm. A variance among the areas of the outer surfaces of the side walls and a variance among the volumes of the side walls are almost the same as the variance among the lengths of the side walls. Therefore, a variance of the pushing pressure (F/(S×t)) acting on unit volume of each side wall is approximately ±0.5%. Based on the above, the above-mentioned formula (2) is obtained.

Figure 4:
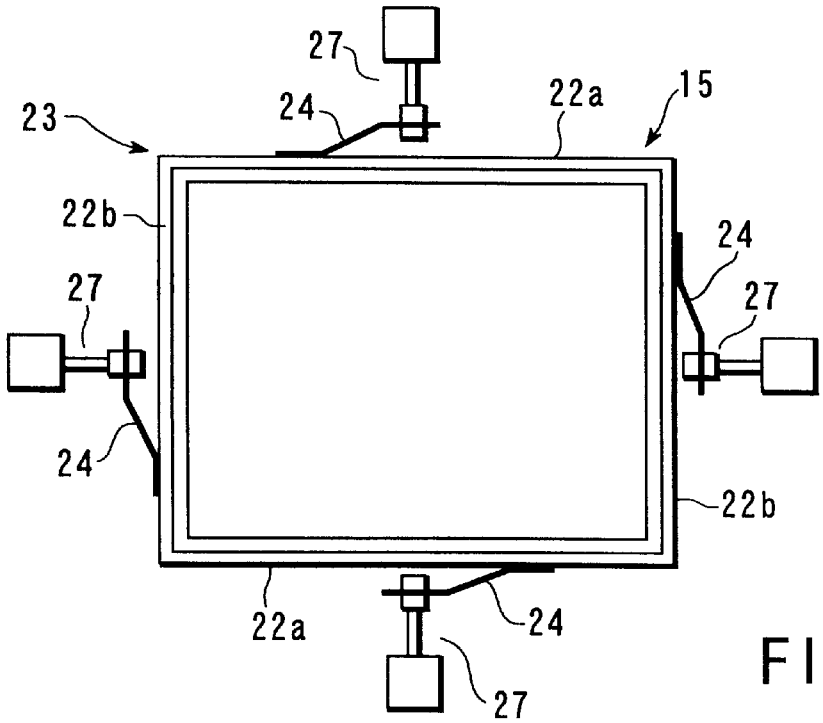
FIG. 4 is a front view for use in explaining a method of measuring the pushing pressures acting from the mask holders onto the mask frame.

The pushing pressures F1 and F2 acting on the long side walls 22*a* and short side walls 22*b* of the mask frame 23 are measured in the following manner:

As shown in FIG. 4, four pressure sensors 27 are respectively arranged in the positions which are close to the respective side walls of the mask frame 23, and which correspond to the positions of the supporting pins 25 of the panel 12, and the mask holders 24 provided at the mask frame 23 are compressed and engaged with the pressure sensors 27 such that the pressure sensors are inserted into the through holes of the respective mask holders 24. In this state, pressures act on the pressure sensors 27, and are thus measured as the above pushing pressures F1 and F2.

Table 1 shows the relationships between the long and short side walls and the pushing pressures F1 and F2 with respect to a 21 inch type color cathode ray tube having an aspect ratio of 4:3, to which the present invention is applied, and with respect to a conventional cathode ray tube of the same type.

TABLE 1

| | | embodiment | prior art |
|---|---|---|---|
| long side wall portion | length Lx (mm) | 413.7 | 413.7 |
| | plate thickness t1 (mm) | 1.6 | 1.6 |
| | area S1 of outer surface ($mm^2$) | $1.65 \times 10^3$ | $1.65 \times 10^3$ |
| | pushing pressure F1 (kg) | 1.56 | 1.48 |
| short side wall portion | length Ly (mm) | 315.7 | 315.7 |
| | plate thickness t2 (mm) | 1.6 | 1.6 |
| | area S2 of outer surface ($mm^2$) | $1.65 \times 10^3$ | $1.65 \times 10^3$ |
| | pushing pressure F2 (kg) | 1.13 | 1.51 |
| pushing pressure acting on unit volume of long side wall portion F1/(S1 × t1) ($kg/mm^3$) | | $5.9 \times 10^{-4}$ | $5.6 \times 10^{-4}$ |
| pushing pressure acting on unit volume of short side wall portion F2/(S2 × t2) ($kg/min^3$) | | $5.6 \times 10^{-4}$ | $7.5 \times 10^{-4}$ |
| $\frac{F1/(S1 \times t1)}{F2/(S2 \times t2}$ | | 1.05 | 0.75 |

The conventional cathode ray tube, as shown in the above table 1, satisfies the following relationships:

$$F1/(S1 \times t1) = 1.48/(1.65 \times 10^3 \times 1.6) = 5.6 \times 10^{-4}\ \text{kg/mm}^3$$

$$F1/(S2 \times t2) = 1.51/(1.26 \times 10^3 \times 1.6) = 7.5 \times 10^{-4}\ \text{kg/mm}^3$$

In such a manner, the pushing pressure F2 acting on a unit volume of the short side wall is greater than the pushing pressure F1 acting on a unit volume of the long side wall. Further, the pushing pressure F1/(S1×t1) acting on the unit volume of the long side wall and the pushing pressure F2/(S2×t2) acting on the unit volume of the short side wall has the following ratio:

$$\frac{F1/(S1 \times t1)}{F2/(S2 \times t2)} = 0.75$$

On the other hand, the color cathode ray tube according to the embodiment of the present invention satisfies the following relationships:

$$F1/(S1 \times t1) = 1.56/(1.65 \times 10^3 \times 1.6) = 5.9 \times 10^{-4}\ \text{kg/mm}^3$$

$$F1/(S2 \times t2) = 1.13/(1.26 \times 10^3 \times 1.6) = 5.6 \times 10^{-4}\ \text{kg/mm}^3$$

The pushing pressure F1/(S1×t1) acting on the unit volume of the long side wall 22*a* is nearly equal to the pushing pressure F2(S2×t2) on the unit volume of the short side wall 22*b*, and the ratio between these pushing pressures is as follows:

$$\frac{F1/(S1 \times t1)}{F2/(S2 \times t2)} = 1.05$$

Thus, the mask frame 23 satisfies the above-mentioned formulas (1) and (2).

More specifically, supposing the mask holders 24 have the same structure, the pushing pressures F1 and F2 acting on the unit volume of the long and short side walls 22*a* and 22*b* can be nearly equalized by adjusting the distance between the supporting pin 25 and the outer surface of the long side wall 22*a* and the distance between the supporting pin 25 and the outer surface of the short side wall 22*b* such that the former distance differs from the latter distance. Alternatively, they can be done by adjusting the heights (widths), the plate thickness, or the shapes of the long and short side walls 22*a* and 22*b*, and by adjusting the thickness or materials of the mask holders 24 provided on the long and short side walls 22*a* and 22*b*, so as to differ between the long side wall side and the short side wall side. To summarize, the pushing pressures F1 and F2 acting on the unit volume of the long and short side walls 22*a* and 22*b* can be appropriately adjusted such that the long side wall side differs from the short side wall portion side with respect to at least one of the above conditions, i.e., the distance between the side wall portion and the supporting pin 25, the height and plate thickness of the side wall, and the shape, plate thickness and material of the mask holder 24.

Figure 5:
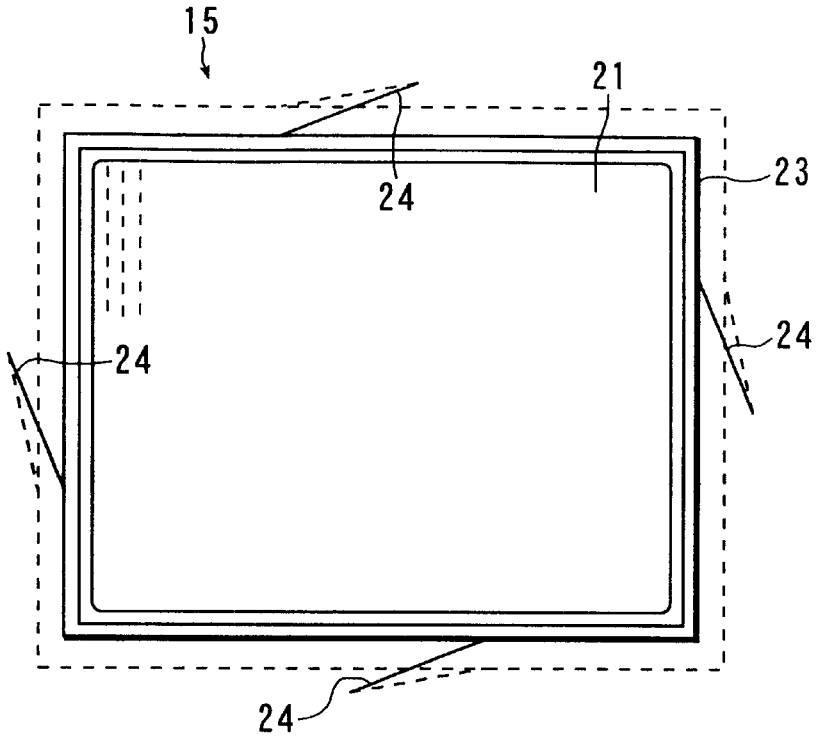
FIG. 5 is a front view for schematically illustrating the thermal expansion of the mask frame.
Figure 6:
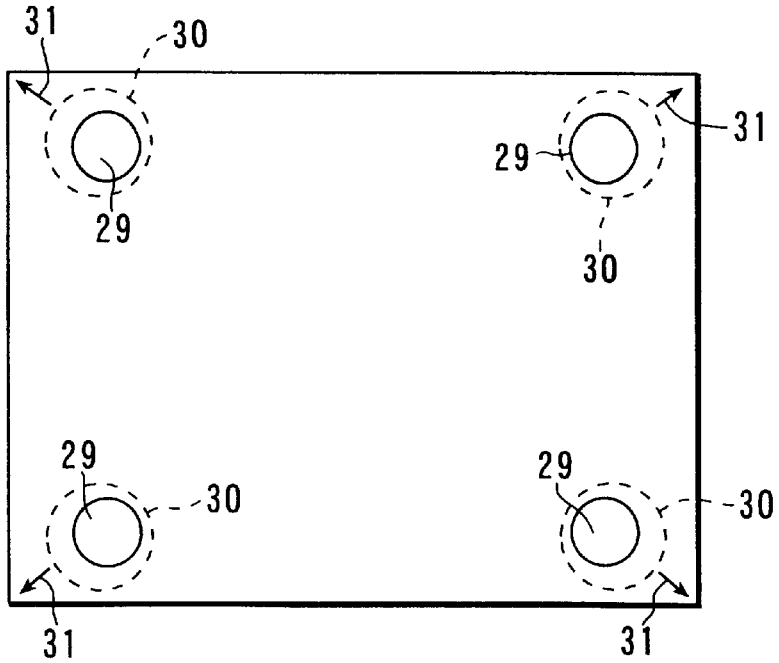
FIG. 6 is a view for schematically illustrating the displacement of beam spots which is caused by landing error of electron beams on phosphor layers.

In the case where the pushing pressure F1 is n early equal to the pushing pressure F2 as mentioned above, when the mask frame 23 is heated, it substantially uniformly thermal-expands in a radially outward direction throughout its entire outer periphery as shown by a broken line in FIG. 5. Therefore, lowering of the color purity due to the thermal expansion of the mask frame 23 is substantially uniform in the vicinity of the diagonal portions of the screen. In other words, beam spots 30 of electron beams on the phosphor layers 29 are substantially uniformly displaced (landing error) in the radial direction as shown by arrows 31 in FIG. 6. Thus, the landing err or can be relatively easily corrected.

A color cathode ray tube according to another embodiment of the present invention will be explained.

In the above embodiment, the shadow mask 15 is formed such that the pushing pressure acting on the unit volume of the long side wall 22*a* of the mask frame 23 is substantially equal to that acting on the unit volume of the short side wall 22*b* of the mask frame 23. However, if the mask frame 23 has a substantially uniform thickness, the same effect can be obtained as in the above embodiment by forming the mask frame 23 so as to satisfy the following formula (3), and preferably to satisfy the following formula (4):

$$F1/S1 \approx F2/S2 \tag{3}$$

$$0.9 < \frac{F1/S1}{F2/S2} < 1.1 \tag{4}$$

Furthermore, if the mask frame 23 has a substantially uniform plate thickness and the heights of the long and short side walls 22*a* and 22*b* are substantially equal to each other, the same effect can be obtained as in the above embodiment by forming the mask frame 23 to satisfy the following formula (5), and preferably to satisfy the following formula (6):

$$F1/Lx \approx F2/Ly \tag{5}$$

$$0.9 < \frac{F1/Lx}{F2/Ly} < 1.1 \tag{6}$$

where Lx is the length of the long side wall, and Ly is the length of the short side wall (See FIG. 3).

Table 2 shows the relationships between the lengths Lx and Ly of the long and short side walls and the pushing pressures F1 and F2 with respect to a 21 inch type color cathode ray tube to which the other embodiment is applied, and with respect to conventional color cathode ray tube of the same type.

TABLE 2

| | | embodiment | prior art |
|---|---|---|---|
| long side wall portion | length Lx (mm) | 413.7 | 413.7 |
| | pushing pressure F1 (kg) | 1.56 | 1.48 |
| short side wall portion | length Ly (mm) | 315.7 | 315.7 |
| | pushing pressure F2 (kg) | 1.13 | 1.51 |
| pushing pressure on long side wall portion F1/Lx (kg/mm) | | $3.8 \times 10^{-3}$ | $3.6 \times 10^{-3}$ |
| pushing pressure on short side wall portion F2/Ly) (kg/mm) | | $3.6 \times 10^{-3}$ | $4.8 \times 10^{-3}$ |
| $\frac{F1/Lx}{F2/Ly}$ | | 1.06 | 0.75 |

As may be understood from the table 2, the conventional color cathode ray tube satisfies the following relationships:

$$F1/Lx = 1.48/413.7$$

$$= 3.6 \times 10^{-3} \text{ kg/mm}$$

$$F2/Ly = 1.51/315.7$$

$$= 4.8 \times 10^{-3} \text{ kg/mm}$$

Therefore, the pushing pressure F2/Ly acting on a unit length of the short side wall is greater than the pushing pressure F1/Lx acting on a unit length of the long side wall. The pushing pressures F1/Lx and F2/Ly has the following ratio:

$$\frac{F1/Lx}{F2/Ly} = 0.75$$

On the other hand, the other embodiment of the present invention satisfies the following relationships:

$$F1/Lx = 1.56/413.7$$

$$= 3.8 \times 10^{-3} \text{ kg/mm}$$

$$F2/Ly = 1.13/315.7$$

$$= 3.6 \times 10^{-3} \text{ kg/mm}$$

Therefore, the pushing pressure F1/Lx acting on the unit length of the long side wall is nearly equal to the pushing pressure F2/Ly acting on the unit length of the short side wall. The pushing pressures F1/Lx and F2/Ly satisfy the following ratio:

$$\frac{F1/Lx}{F2/Ly} = 1.06$$

Thus, the mask frame 23 satisfies the above formulas (5) and (6).

In such a manner, in the other embodiment also, the same effect can be obtained as in the aforementioned embodiment, if the mask frame has a substantially uniform plate thickness, and the heights of the long and short side walls are substantially equal to each other.

As described above in detail, according to the present invention, there can be provided a color cathode ray tube wherein the mask frame is prevented from being non-uniformly deformed due to its thermal expansion, and lowering of the color purity due the thermal expansion of the mask frame can be appropriately corrected.

The present invention is not limited to the above mentioned embodiments, and various modifications can be applied within the scope of the invention. For example, the present invention is not limited to a color cathode ray tube having an aspect ratio of 4:3, and can be applied to a color cathode ray tube having an aspect ratio of 16:9.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope comprising a funnel and a panel including a substantially rectangular effective portion and a skirt portion provided at a peripheral portion of the effective portion, the effective portion having an inner surface on which a phosphor screen is formed, the funnel being joined to the skirt portion;

a shadow mask arranged to oppose the phosphor screen; and an electron gun arranged in a neck of the funnel, for emitting electron beams onto the phosphor screen through the shadow mask;

the shadow mask comprising:

a substantially rectangular effective surface having a large number of electron beam passage apertures, for allowing the electron beams to pass therethrough, the effective surface having a center located on a tube axis, and a major axis and a minor axis extending perpendicular to each other through the center, a substantially rectangular mask frame attached to a peripheral portion of the mask body, and having a pair of long side walls extending substantially in parallel to the major axis of the effective surface and a pair of short side walls extending substantially in parallel to the minor axis of the effective surface, and elastic supporting members respectively provided on outer surfaces of the long side walls and short side walls of the mask frame, the elastic supporting members being respectively engaged with supporting pins provided on the skirt portion to support the shadow mask; and the mask frame being formed to satisfy the following relationship:

$$F1/(S1 \times t1) \approx F2/(S2 \times t2)$$

where S1 is an area of the outer surface of the long side wall of the mask frame, t1 is a thickness of the long side wall, S2 is an area of the outer surface of the short side wall, t2 is a thickness of the short side wall, F1 is a pushing pressure acting from the elastic member onto the long side wall when the elastic member is engaged with the supporting pin to support the shadow mask, and F2 is a pushing pressure acting from the elastic member onto the short side wall when the elastic member is engaged with the supporting pin to support the shadow mask.

2. A color cathode ray tube according to claim 1, wherein the mask frame satisfies the following relationship:

$$0.9 < \frac{F1/(S1 \times t1)}{F2/(S2 \times t2)} < 1.1.$$

3. A color cathode ray tube according to claim 1, wherein the mask frame satisfies the following relationship:

Ly/Lx 21 0.80, wherein Lx is the length of the long side wall of the mask frame which is measured along the major axis, and Ly is a length of the short side wall of the mask frame which is measure along the minor axis.

4. A color cathode ray tube according to claim 1, wherein the pushing pressures F1 and F2 are adjusted by changing at least one of the following groups:

1.) a height and thickness of each of the long and short side walls,

2.) a shape, a thickness and material of each of the elastic supporting members, 3.) distances between the outer surfaces of the long and short side walls and 4.) the supporting pins which are measured when the shadow mask is supported.

5. A color cathode ray tube comprising:

an envelope comprising a funnel and a panel including a substantially rectangular effective portion and a skirt portion provided at a peripheral portion of the effective portion, the effective portion having an inner surface on which a phosphor screen is formed, the funnel being joined to the skirt portion;

a shadow mask arranged to oppose the phosphor screen; and an electron gun arranged in a neck of the funnel, for emitting electron beams onto the phosphor screen through the shadow mask;

the shadow mask comprising:

a substantially rectangular effective surface having a large number of electron beam passage apertures, for allowing the electron beams to pass therethrough, the effective surface having a center located on a tube axis, and a major axis and a minor axis extending perpendicular to each other through the center, a substantially rectangular mask frame attached to a peripheral portion of the mask body, and having a pair of long side walls extending substantially in parallel to the major axis of the effective surface and a pair of short side walls extending substantially in parallel to the minor axis of the effective surface, and elastic supporting members respectively provided on outer surfaces of the long side walls and short side walls of the mask frame, the elastic supporting members being respectively engaged with supporting pins provided on the skirt portion to support the shadow mask; and the mask frame being formed to satisfy the following relationship:

F1/S1≈F2/S2 where S1 is an area of the outer surface of the long side wall of the mask frame, S2 is an area of the outer surface of the short side wall, F1 is a pushing pressure acting from the elastic member onto the long side wall when the elastic member is engaged with the supporting pin to support the shadow mask, and F2 is a pushing pressure acting from the elastic member onto the short side wall when the elastic member is engaged with the supporting pin to support the shadow mask.

6. A color cathode ray tube according to claim 5, wherein the mask frame satisfies the following relationship:

$$0.9 < \frac{F1/S1}{F2/S2} < 1.1.$$

7. a color cathode ray tube according to claim 5, wherein the mask frame satisfies the following relationship:

Ly/Lx<0.80 where Lx is a length of the long side wall of the mask frame which is measured along the major axis, and Ly is a length of the short side wall of the mask frame which is measured along the minor axis.

8. A color cathode ray tube according to claim 5, wherein the pushing pressures F1 and F2 are adjusted by changing items of at least one of the following groups:

1.) a height and thickness of each of the long and short side walls,

2.) a shape, a thickness and material of each of the elastic supporting members, 3.) distances between the outer surfaces of the long and short side walls and 4.) the supporting pins which are measured when the shadow mask is supported.

9. A color cathode ray tube comprising:

an envelope comprising a funnel and a panel including a substantially rectangular effective portion and a skirt portion provided at a peripheral portion of the effective portion, the effective portion having an inner surface on which a phosphor screen is formed, the funnel being joined to the skirt portion;

a shadow mask arranged to oppose the phosphor screen; and an electron gun arranged in a neck of the funnel, for emitting electron beams onto the phosphor screen through the shadow mask;

the shadow mask comprising:

a substantially rectangular effective surface having a large number of electron beam passage apertures, for allowing the electron beams to pass therethrough, the effective surface having a center located on a tube axis, and a major axis and a minor axis extending perpendicular to each other through the center, a substantially rectangular mask frame attached to a peripheral portion of the mask body, and having a pair of long side walls extending substantially in parallel to the major axis of the effective surface and a pair of short side walls extending substantially in parallel to the minor axis of the effective surface, and elastic supporting members respectively provided on outer surfaces of the long side walls and short side walls of the mask frame, the elastic supporting members being respectively engaged with supporting pins provided on the skirt portion to support the shadow mask; and the mask frame being formed to satisfy the following relationship:

$$F1/Lx \approx F2/Ly$$

where Lx is a length of the long side wall of the mask frame which is measured along the major axis, Ly is a length of the short side wall of the mask frame which is measured along the minor axis, F1 is a pushing pressure acting from the elastic member onto the long side wall when the elastic member is engaged with the supporting pin to support the shadow mask, and F2 is a pushing pressure acting from the elastic member onto the short side wall when the elastic member is engaged with the supporting pin to support the shadow mask.

10. A color cathode ray tube according to claim 9, wherein the mask frame satisfies the following relationship:

$$0.9 < \frac{F1/Lx}{F2/Ly}$$

11. A color cathode ray tube according to claim 9, wherein the mask frame satisfies the following relationship:

$$Ly/Lx < 0.80$$

12. A color cathode ray tube according to claim 9, wherein the pushing pressures F1 and F2 are adjusted by changing items of at least one of the following groups:

1.) a height and thickness of each of the long and short side walls,

2.) a shape, a thickness and material of each of the elastic supporting members, 3.) distances between the outer surfaces of the long and short side walls, and 4.) the supporting pins which are measured when the shadow mask is supported.

* * * * *